US009856832B2

(12) United States Patent
Muresan

(10) Patent No.: US 9,856,832 B2
(45) Date of Patent: Jan. 2, 2018

(54) MIXER VALVE OF AN INTERNAL COMBUSTION ENGINE

(71) Applicant: CONTINENTAL AUTOMOTIVE GMBH, Hannover (DE)

(72) Inventor: Daniel Muresan, Giroc (RO)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/915,846

(22) PCT Filed: Jul. 23, 2014

(86) PCT No.: PCT/EP2014/065800

§ 371 (c)(1),
(2) Date: Mar. 1, 2016

(87) PCT Pub. No.: WO2015/028207

PCT Pub. Date: Mar. 5, 2015

(65) Prior Publication Data

US 2016/0195043 A1 Jul. 7, 2016

(30) Foreign Application Priority Data

Sep. 2, 2013 (EP) ..... 13464011

(51) Int. Cl.

| | |
|---|---|
| ***F02M 26/51*** | (2016.01) |
| ***F02M 26/54*** | (2016.01) |
| ***F02M 26/64*** | (2016.01) |
| ***F02M 26/70*** | (2016.01) |
| ***F02M 26/21*** | (2016.01) |
| ***F02M 26/52*** | (2016.01) |

(52) U.S. Cl.
CPC ..... *F02M 26/51* (2016.02); *F02M 26/21* (2016.02); *F02M 26/52* (2016.02); *F02M 26/54* (2016.02); *F02M 26/64* (2016.02); *F02M 26/70* (2016.02)

(58) Field of Classification Search
CPC ..... F02M 26/51; F02M 26/21; F02M 26/52; F02M 26/54; F02M 26/64; F02M 26/70
USPC ..... 123/568.18
See application file for complete search history.

(56) References Cited

U.S. PATENT DOCUMENTS

| | | | | |
|---|---|---|---|---|
| 8,905,009 | B2 * | 12/2014 | Moritani | F02D 41/0077 123/337 |
| 2005/0241702 | A1 | 11/2005 | Blomquist et al. | |
| 2006/0283430 | A1 * | 12/2006 | Atkinson | F02D 11/10 123/568.19 |
| 2009/0293973 | A1 * | 12/2009 | Albert | F02B 29/0418 137/625.44 |

(Continued)

FOREIGN PATENT DOCUMENTS

| | | | |
|---|---|---|---|
| DE | 1771821 | U | 8/1958 |
| DE | 10 2008 030 785 | A1 | 12/2009 |

(Continued)

*Primary Examiner* — Carlos A Rivera
*Assistant Examiner* — Anthony Taylor, Jr.
(74) *Attorney, Agent, or Firm* — Cozen O'Connor

(57) ABSTRACT

A mixer valve of an internal combustion engine of a motor vehicle includes a single servo-motor and a differential. A flap arranged in an intake port and a flap arranged in a exhaust duct are driven by a differential. Spring elements tension the flaps in a base position counter to the stops and determine which of the flaps is driven in which control area of the servo-motor.

5 Claims, 2 Drawing Sheets

(56) References Cited

U.S. PATENT DOCUMENTS

| | | | | |
|---|---|---|---|---|
| 2010/0206274 | A1* | 8/2010 | Furukawa | F16K 35/14 123/568.11 |
| 2011/0114211 | A1* | 5/2011 | Leroux | F02M 26/06 137/625.45 |
| 2012/0056118 | A1* | 3/2012 | Yokoyama | F16K 1/223 251/248 |
| 2012/0317978 | A1* | 12/2012 | Streutker | F02D 9/04 60/605.2 |
| 2013/0047967 | A1* | 2/2013 | Hodebourg | F16K 11/22 123/568.15 |
| 2015/0027423 | A1 | 1/2015 | Weis | |

FOREIGN PATENT DOCUMENTS

| | | | | |
|---|---|---|---|---|
| DE | 102008030785 | A1 * | 12/2009 | F02M 26/26 |
| DE | 10 2012 203156 | A1 | 8/2013 | |

* cited by examiner

MIXER VALVE OF AN INTERNAL COMBUSTION ENGINE

CROSS-REFERENCE TO RELATED APPLICATIONS

This is a U.S. national stage of application No. PCT/EP2014/065800, filed on 23 Jul. 2014, which claims priority to the European Application No. 13464011.9 filed 2 Sep. 2013, the content of both incorporated herein by reference.

BACKGROUND OF THE INVENTION

1. Field of the Invention

The invention relates to a mixer valve of an internal combustion engine of a motor vehicle having a flap arranged in an intake duct and a flap arranged in an exhaust gas duct, having rotatably mounted shafts which hold the flaps, the intake duct and the exhaust gas duct opening into a common collector duct, and having a drive device of the flaps, the drive device having a single actuating motor and a gear mechanism for actuating the two flaps.

2. Related Art

Mixer valves of this type are frequently used in exhaust gas recirculation systems of internal combustion engines of current motor vehicles and are known from practice. The movements of the flaps of the intake duct and the exhaust gas duct are controlled such that the flap arranged in the exhaust gas duct opens, starting from the first position, linearly with an actuating signal of the drive device. However, the flap arranged in the intake duct remains first of all in the first position and is not moved until the drive device has been driven by a provided actuating range.

The flaps are therefore to be actuated independently of one another. In the mixer valve known from practice, actuating levers and dead travels are provided in the gear mechanism, which decouple the flaps in provided actuating ranges from the drive device. However, this leads to a high structural complexity of the gear mechanism.

SUMMARY OF THE INVENTION

Based on the problem of developing a mixer valve of the type mentioned at the outset it is an object of the invention develop a mixing valve of particularly simple construction and which makes decoupling of the drive of the flaps possible.

According to an aspect of the invention, the problem is solved by virtue of the fact that the gear mechanism has a differential gear mechanism, and that the differential gear mechanism is arranged between the two shafts.

As a result of this design, in each case that shaft is driven which offers the lowest resistance to the drive. The flaps are decoupled simply according to the invention by virtue of the fact that one flap is held in its starting position with a somewhat greater force or bears against a stop. As a result, the number of movable components is kept particularly low. The number of hardware and software components of the mixer valve can be kept particularly low thanks to the invention. The mixer valve is therefore of particularly simple construction. Known differential gear mechanisms are additionally a particularly compact design, with the result that the mixer valve has particularly small dimensions.

The decoupling of the movements of the flaps is of structurally particularly simple design according to another advantageous development of the invention if at least one of the shafts is prestressed into a basic position by a spring element.

According to another advantageous development of the invention, the drive device generates an active closing movement of the flap arranged in the intake duct if the flap arranged in the intake duct is prestressed into an open position against a stop. The position of the flap arranged in the intake duct is preferably detected by way of a contactless sensor.

According to another advantageous development of the invention, a contribution is made to the simplification of the construction of the mixer valve if the flap arranged in the exhaust gas duct is prestressed into the closed position against a stop.

According to another advantageous development of the invention, the transition of the drive of the flap arranged in the exhaust gas duct to the flap arranged in the intake duct is of particularly simple design if the flap arranged in the exhaust gas duct has a second stop in the open position.

Targeted control of the flaps can be achieved simply according to another advantageous development of the invention if a spring element that prestresses the flap arranged in the intake duct has a greater spring stiffness than a spring element that prestresses the flap arranged in the exhaust gas duct. As a result of this design, the flap arranged in the exhaust gas duct is first of all opened completely. The flap arranged in the intake duct is only subsequently actuated. The flap arranged in the exhaust gas duct remains completely in its open position.

According to another advantageous development of the invention, the ratio of the maximum flows in the mixer valve can be set simply if the exhaust gas duct has a greater flow resistance than the intake duct.

BRIEF DESCRIPTION OF THE DRAWINGS

The invention allows numerous embodiments. For further clarification of its basic principle, one of said embodiments is shown in the drawing and will be described in the following text. In the drawings.

DETAILED DESCRIPTION OF THE PRESENTLY PREFERRED EMBODIMENTS

Figure 1:
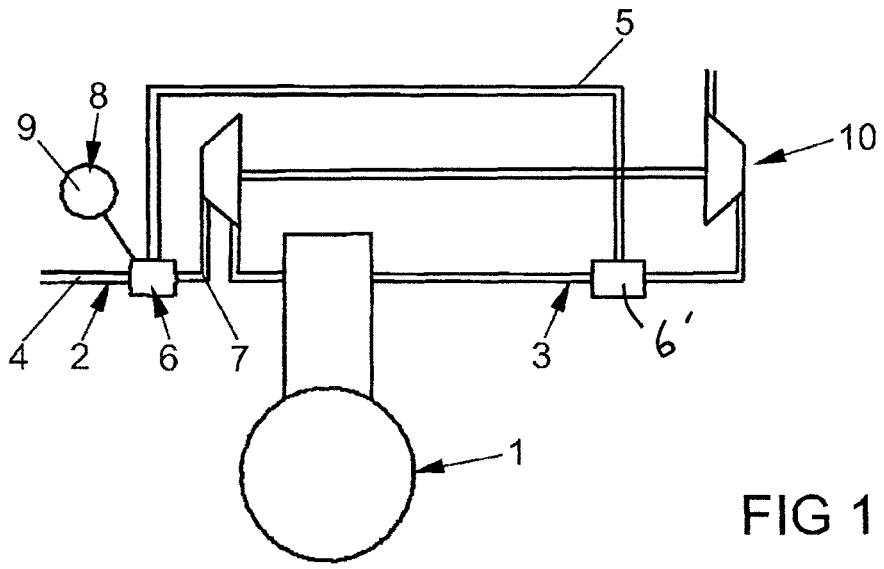
FIG. 1 diagrammatically shows an internal combustion engine having a mixer valve.

FIG. 1 diagrammatically shows an internal combustion engine 1 having an intake line 2 and an exhaust gas line 3. The intake line 2 has an intake duct 4, via which the air is sucked from the surroundings. An exhaust gas duct 5 leads from the exhaust gas line 3 via a mixer valve 6 into the intake line 2. The mixer valve 6 combines gas flows from the intake duct 4 and from the exhaust gas duct 5 to form a common gas flow in a collector duct 7. A second valve 6' permits at least a portion of the flow from the exhaust gas line 3 to flow into the exhaust gas duct 5. The gas flows in the mixer valve 6 can be regulated by a drive device 8 having a single electric actuating motor 9. Furthermore, the internal combustion engine 1 has a turbocharger 10, which compresses a gas flow in the collector duct 7 and feeds it to the internal combustion engine 1. In order to simplify the drawing, further components of the internal combustion engine 1 and of the turbocharger 10, such as sensors, further valves and intercoolers, are not shown.

Figure 2:
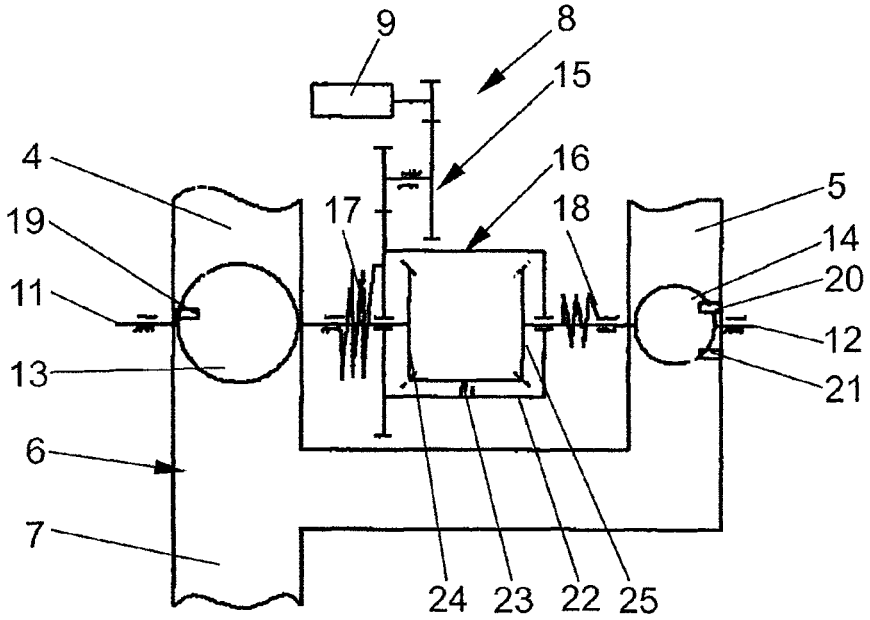
FIG. 2 shows the construction of the mixer valve in a diagrammatic illustration.

FIG. 2 diagrammatically shows the mixer valve 6 with the drive device 8 from FIG. 1. In the intake duct 4 and in the exhaust gas duct 5, the mixer valve 6 in each case has pivotable shafts 11, 12 with flaps 13, 14 respectively arranged thereon for controlling the cross sections of the intake duct 4 and the exhaust gas duct 5. The drive device 8 has a gear mechanism 15, with a differential gear mechanism 16. The single actuating motor 9 drives the gear mechanism 15 which in turn drives the differential gear mechanism 16. The shafts 11, 12 and therefore the respective flaps 13, 14, are driven via the differential gear mechanism 16. In addition, the flaps 13, 14 are prestressed in each case by spring elements 17, 18, respectively into a basic position. In the basic positions, the flaps 13, 14 bear against diagrammatically illustrated stops 19, 20, respectively. The shafts 11, 12 are mounted in a housing (not shown) of the mixer valve 6. In addition, the housing accommodates the actuating motor 9 and the gear mechanism 15 with the differential gear mechanism 16.

The differential gear mechanism 16 has a cage 22 driven directly by the gear mechanism 15 and in which a planetary gear 23 is mounted. The planetary gear 23 is in engagement with two drive gears 24, 25. The drive gears 24, 25 are connected fixedly to the shafts 11, 12 so as to rotate with them.

The spring element 17 of the flap 13 arranged in the intake duct 4 has a greater spring stiffness than the spring element 18 of the flap 14 arranged in the exhaust gas duct 5. Therefore, during initial operation of the actuating motor 9, first of all the flap 14 arranged in the exhaust gas duct 5 is actuated, until it comes into contact with a second stop 21. During further operation of the drive device 8, the flap 14 arranged in the exhaust gas duct 5 is held on the second stop 21 and the flap 13 arranged in the intake duct 4 is adjusted.

Figure 3:
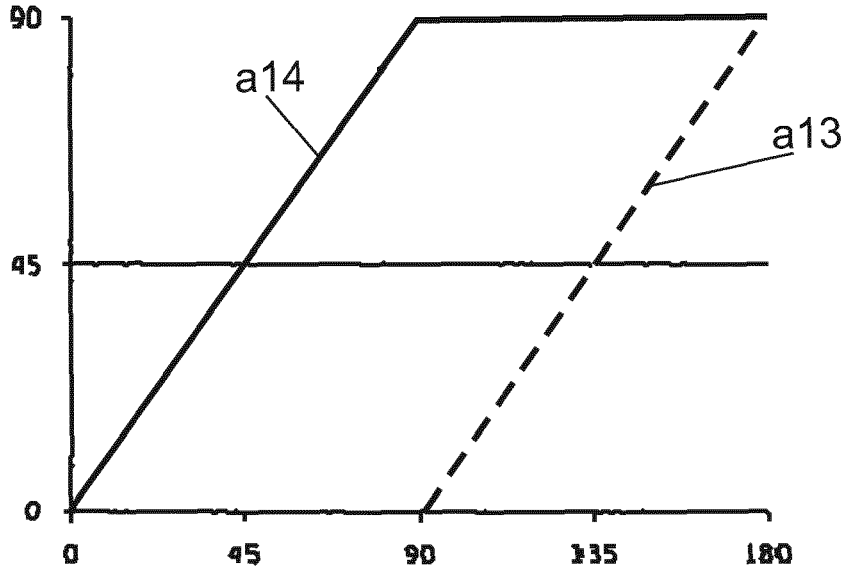
FIG. 3 shows a diagram of the pivoting movements of the flaps as a function of the actuating angle of a drive device.

The movements of the flaps 13, 14 between a basic position and a position rotated by 90° with respect to the former over an actuating angle of from 0° to 180° are shown in FIG. 3. Here, the movement of the flap 14 arranged in the exhaust gas duct 5 is denoted by a14 and the movement of the flap 13 arranged in the intake duct 4 is denoted by a13.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A mixer valve (6) of an internal combustion engine (1) of a motor vehicle, the mixer valve (6) comprising:

an intake duct (4);

an exhaust gas duct (5);

a common collector duct (7), the intake duct (4) and the exhaust gas duct (5) opening into the common collector duct (7);

a first flap (13) arranged in the intake duct (4);

a second flap (14) arranged in the exhaust gas duct (5);

a first rotatably mounted shaft (11) holding the first flap (13);

a second rotatably mounted shaft (12) holding the second flap (14); and a drive device (8) configured to drive the first and second flaps (13, 14), the drive device (8) having a single actuating motor (9) and a gear mechanism (15) configured to actuate the first and second flaps (13, 14), wherein the gear mechanism (15) has a differential gear mechanism (16), and the differential gear mechanism (16) is arranged between the first and second rotatably mounted shafts (11, 12), and wherein both of the first and second rotatably mounted shafts (11, 12) are prestressed into a basic position by respective first and second spring elements (17, 18), wherein the first spring element (17) has a greater spring stiffness than the second spring element (18) so as to provide a force holding the first flap (13) in a starting position of the first flap that is greater than a force holding the second flap (14) in a starting position of the second flap, such that a delay occurs between actuation of the second flap (14) into an open position and actuation of the first flap (13).

2. The mixer valve as claimed in claim 1, wherein the first flap (13) is prestressed into an open position against a first-flap stop (19).

3. The mixer valve as claimed in claim 2, wherein the second flap (14) is prestressed into a closed position against a first second-flap stop (20).

4. The mixer valve as claimed in claim 3, wherein the second flap (14) has a second second-flap stop (21) in an open position.

5. The mixer valve as claimed in claim 1, wherein the exhaust gas duct has a greater flow resistance than the intake duct.

* * * * *